US005582305A

United States Patent [19]

Howell, Sr. et al.

[11] Patent Number: 5,582,305

[45] Date of Patent: Dec. 10, 1996

[54] MODULAR DISPLAY COMPARTMENT

[75] Inventors: James B. Howell, Sr., Woodcliff Lake, N.J.; Richard Morrell, New City, N.Y.; Jack Gauthier, Southington; Joseph Carbonell, Kensington, both of Conn.

[73] Assignee: The Stanley Works, New Britain, Conn.

[21] Appl. No.: 381,268

[22] Filed: Jan. 31, 1995

[51] Int. Cl.[6] ..... A47F 7/00

[52] U.S. Cl. ..... 211/126; 211/184

[58] Field of Search ..... 211/126, 189, 211/133, 184, 187, 43, 11; 108/60, 61; 160/135; 312/234.4

[56] References Cited

U.S. PATENT DOCUMENTS

| | | | |
|---|---|---|---|
| 2,730,825 | 1/1956 | Wilds . | |
| 2,934,214 | 4/1960 | Mogulescu et al. | 211/184 X |
| 2,934,215 | 4/1960 | Mogulescu et al. | 211/184 X |
| 3,387,808 | 6/1968 | Metcalf . | |
| 3,750,894 | 8/1973 | Jensen et al. . | |
| 3,862,784 | 1/1975 | Heinrich . | |
| 3,872,976 | 3/1975 | Moore et al. . | |
| 4,212,506 | 7/1980 | Merl . | |
| 4,395,955 | 8/1983 | Pfeifer . | |
| 4,538,737 | 9/1985 | Delaney | 211/184 X |
| 4,592,601 | 6/1986 | Hlinsky et al. . | |
| 4,615,276 | 10/1986 | Garabedian . | |
| 4,712,694 | 12/1987 | Breslow . | |
| 4,768,661 | 9/1988 | Pfeifer . | |
| 4,775,058 | 10/1988 | Yatsko . | |
| 4,896,779 | 1/1990 | Jureckson . | |
| 5,161,704 | 11/1992 | Valeulis | 211/184 |
| 5,265,738 | 11/1993 | Yablans et al. . | |
| 5,314,081 | 5/1994 | Carroll . | |
| 5,341,945 | 8/1994 | Gibson | 211/184 |
| 5,360,122 | 11/1994 | Benton . | |
| 5,360,263 | 11/1994 | Nakano et al. . | |
| 5,450,968 | 9/1995 | Bustos | 211/184 X |

*Primary Examiner*—Alvin C. Chin-Shue
*Assistant Examiner*—Sarah L. Purol
*Attorney, Agent, or Firm*—Klauber & Jackson

[57] ABSTRACT

A modular compartment for displaying products therein. The modular compartment comprises in one unit a front panel, a pair of side panels which interlock with the front panel, and a back panel which interlocks with the side panels. The side panels have snap off sections for adjusting the depth of the modular compartment so as to adapt to different shelving dimensions. The side panels also have snap out connector pins for securing together adjacent modular compartments. One or more lateral dividers may be provided for separating products within each modular compartment. Also, an optional perforated peg panel may be snap fit onto the front panel so that mating peg clips and/or actual representative products may be displayed on the front of the modular compartment. Both the front panel and the optional perforated peg panel have guides formed therein for retaining product identifier strips.

22 Claims, 18 Drawing Sheets

MODULAR DISPLAY COMPARTMENT

FIELD OF THE INVENTION

The present invention relates to product displays and, more particularly, to a modular compartment for displaying products therein.

DESCRIPTION OF THE PRIOR ART

Product displays are used to advertise and promote products so as to maintain or increase sales. Product displays come in many different forms and the concept upon which many of these product displays are based is a conventional binning arrangement. For example, the following patents are directed to product displays, in particular, or conventional binning arrangements, in general.

In U.S. Pat. No. 3,750,894, Jensen et al. disclose a binning arrangement wherein front, side, rear, and divider walls are held together by clips so as to form a plurality of variously shaped bins.

In U.S. Pat. No. 3,872,976, Moore et al. disclose a binning and banding structure wherein partition sections are interconnected by tongue and groove connectors so as to form compartments.

In U.S. Pat. No. 4,768,661, Pfeifer discloses a binning and banding structure wherein partition sections are connected together with clips so as to form compartments.

In U.S. Pat. No. 4,896,779, Jureckson discloses a display shelf organizer wherein a plurality of dividers are connected to a front channel so as to organize products within the connected structure.

In U.S. Pat. No. 4,775,058, Yatsko discloses a display shelf organizer wherein a plurality of dividers are connected to a front base member so as to organize products within the connected structure.

In U.S. Pat. No. 4,712,694, Breslow discloses a display shelf organizer wherein a plurality of vertical divider members are connected to a front rail member so as to organize products within the connected structure.

In U.S. Pat. No. 2,730,825, Wilds discloses a combination rack and price tagging device wherein a front angle, a back angle, side angles, and horizontal slats are bonded together so as to organize products within the rack structure.

In U.S. Pat. No. 3,862,784, Heinrich discloses a front panel and partition holder for a display shelf wherein a grooved attachment is provided to support front and partition panels within grooves so as to form a compartment for storing products.

In U.S. Pat. No. 4,212,506, Merl discloses a multi-compartment display device wherein a plurality of back bin members connect together a plurality of lateral divider members and a front bin member is secured between each adjacent lateral divider member so as to form a plurality of lateral subdivisions.

In U.S. Pat. No. 4,395,955, Pfeifer discloses banding means for display shelves wherein a frontal banding member comprises a tongue and groove configuration for connecting two frontal banding members together, and a channel and a notch for engaging a partition panel.

In U.S. Pat. No. 4,592,601, Hlinsky et al. disclose an expandable modular storage system wherein storage compartments are formed by interconnecting C-shaped wall elements and flat wall elements.

In U.S. Pat. No. 4,615,276, Garabedian discloses a shelf divider assembly wherein a foot element, a shelf divider element, and an elongated bracket are connected in such a manner so as to divide a shelf into a plurality of discrete shelf sections.

In U.S. Pat. No. 5,265,738, Yablans et al. disclose a shelf display dispenser for packaged merchandise wherein a plurality of sliders are placed side by side for supporting spring loaded pushers which push products up against a stop plate for easy dispensing.

In U.S. Pat. No. 5,314,081, Carroll discloses a riser and divider system for a display apparatus wherein divider connectors effectuate connections between risers and dividers so as to form compartments for the storage of products and/or other various components.

In U.S. Pat. No. 5,360,122, Benton discloses a storage rack with a readily accessible wire track beam wherein a front beam and a rear beam are connected between at least two side beams so as to form a storage rack shelf.

In U.S. Pat. No. 5,360,263, Nakano et al. disclose a modular self-locking panel wherein several self-locking panels may be interconnected edge to edge so as to form a closed polygonal cabinet.

While all of the above described patents are directed toward product displays and/or binning arrangements, none are directed toward a modular display compartment which is adjustable in a modular manner and provides a perforated peg panel upon which mating peg clips and/or actual representative products may be displayed. Such a product display is beneficial for promoting the sale of products contained in the modular compartment. Thus, it would be both novel and desirable to provide such a modular display compartment.

SUMMARY OF THE INVENTION

The present invention contemplates a modular compartment for displaying products therein. The modular compartment comprises in one unit a front panel, a pair of side panels which interlock with the front panel, and a back panel which interlocks with the side panels. The side panels have snap off sections for adjusting the depth of the modular compartment so as to adapt to different shelving dimensions. The side panels also have snap out connector pins for securing together adjacent modular compartments. The snap off and the snap out components are facilitated by the use of a rigid injection molded plastic material for all of the modular compartment components.

One or more lateral dividers may be provided for separating products within each modular compartment. Also, an optional perforated peg panel may be snap fit onto the front panel so that mating peg clips and/or actual representative products may be displayed on the front of the modular compartment. It should be noted that both the front panel and the optional perforated peg panel have guides formed therein for retaining product identifier strips.

Accordingly, the primary objective of the present invention is to provide a rigid and durable modular compartment for displaying products therein.

Other objectives and advantages of the present invention will become apparent to those skilled in the art upon reading the following detailed description and claims, in conjunction with the accompanying drawings which are appended hereto.

BRIEF DESCRIPTION OF THE DRAWINGS

In order to facilitate a fuller understanding of the present invention, reference is now be made to the appended drawings. The drawings should not be construed as limiting the present invention, but are intended to be exemplary only.

PREFERRED EMBODIMENT OF THE PRESENT INVENTION

Figure 1:
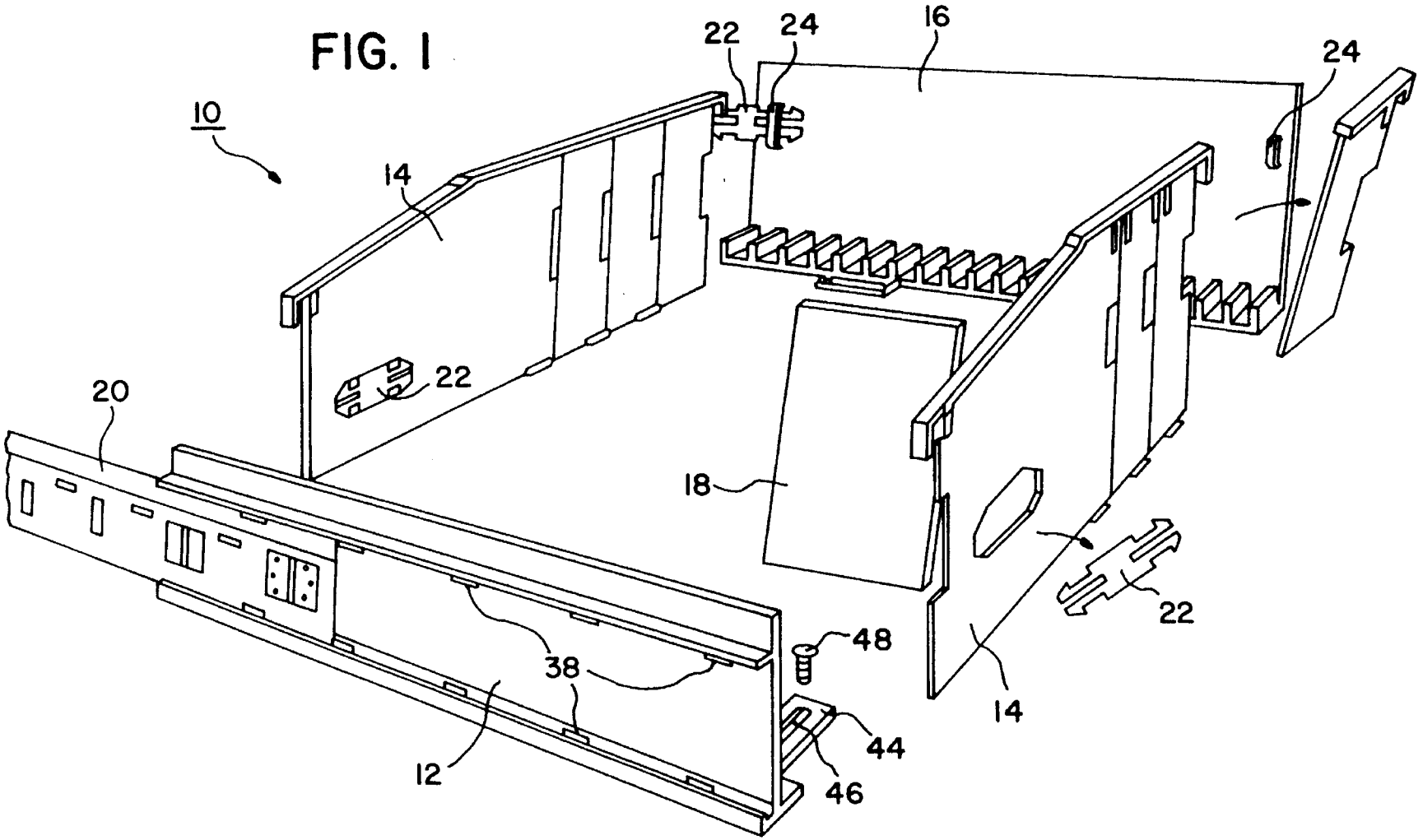
FIG. 1 is an exploded view of one unit of a modular display compartment according to the present invention.

Referring to FIG. 1, there is shown an exploded view of one unit of a modular display compartment 10 according to the present invention. The one unit of the modular display compartment 10 comprises a front panel 12, a pair of side panels 14 which interlock with the front panel 12, and a back panel 16 which interlocks with the side panels 14. Also shown in FIG. 1 is a lateral divider 18 which is supported by the side panels 14 and is used for separating products within the modular compartment 10, and a product identifier strip 20 which is retained on the front panel 12 and is used to identify products within the modular compartment 10. Within each side panel 14 there is formed a snap out connector pin 22 for securing together adjacent modular display compartments 10. The snap out connector pins 22 mate with connector members 24 which are formed in the front 12 and back 16 panels (this mating relationship is demonstrated in one instance on the back panel 16 shown in FIG. 1). It should be noted that the bottom of the modular display compartment 10 is formed by either the shelving or the floor upon which the modular display compartment 10 is placed. It should also be noted that all of the components of the modular display compartment 10 are typically fabricated of a rigid injection molded plastic material, such as high impact styrene (HIPS), unless otherwise indicated.

Figure 2:
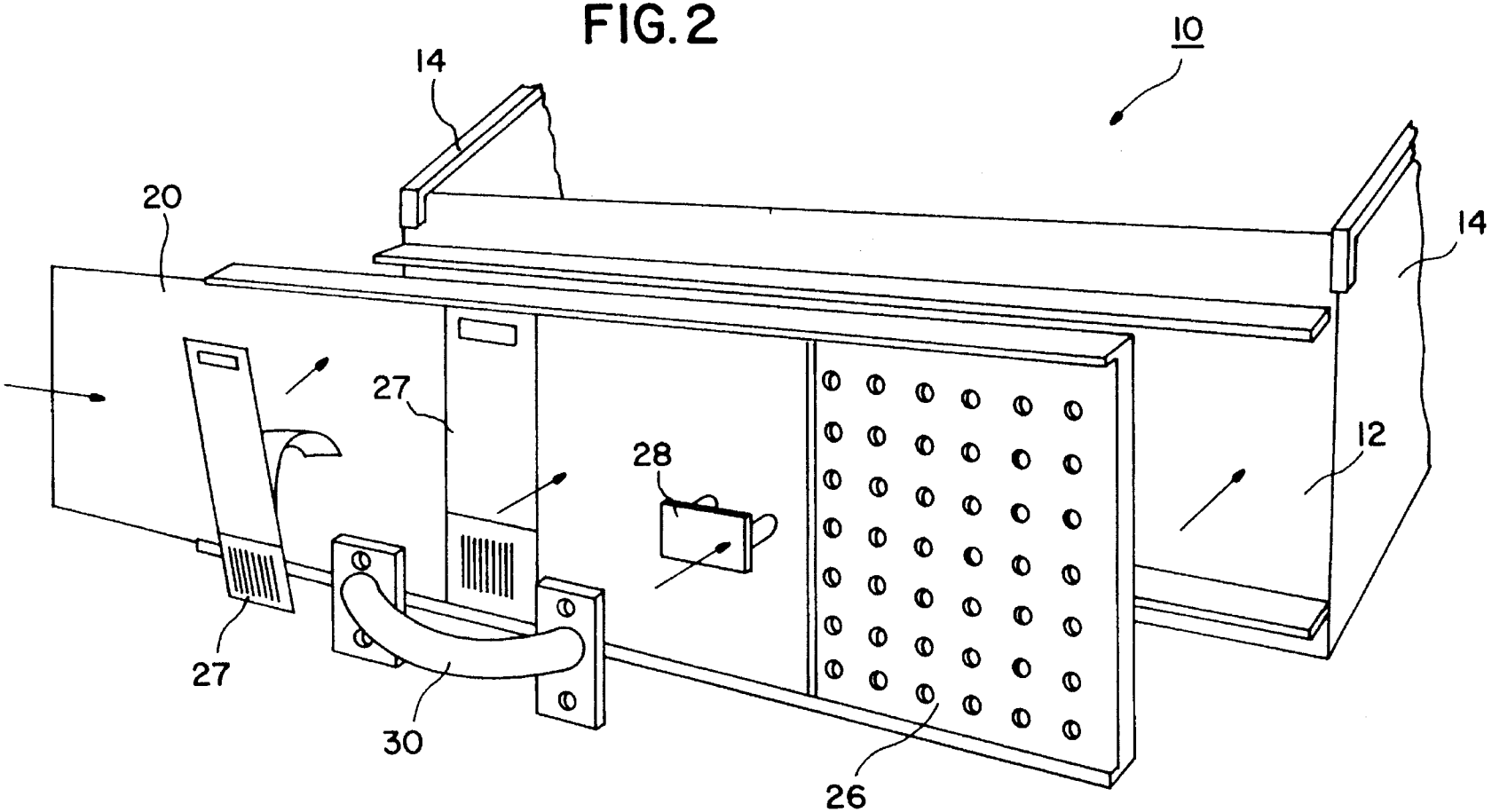
FIG. 2 shows a perforated peg panel which snap fits onto a front panel of a modular display compartment according to the present invention.

Referring to FIG. 2, there is shown a perforated peg panel 26 which snap fits onto the front panel 12. Similar to the front panel 12, the perforated peg panel 26 may accommodate a product identifier strip 20 having individual product identifier tabs 27 affixed thereto. The perforated peg panel 26 may also accommodate mating peg clips 28 for displaying actual representative products 30 on the front of the modular display compartment 10.

Figure 3:
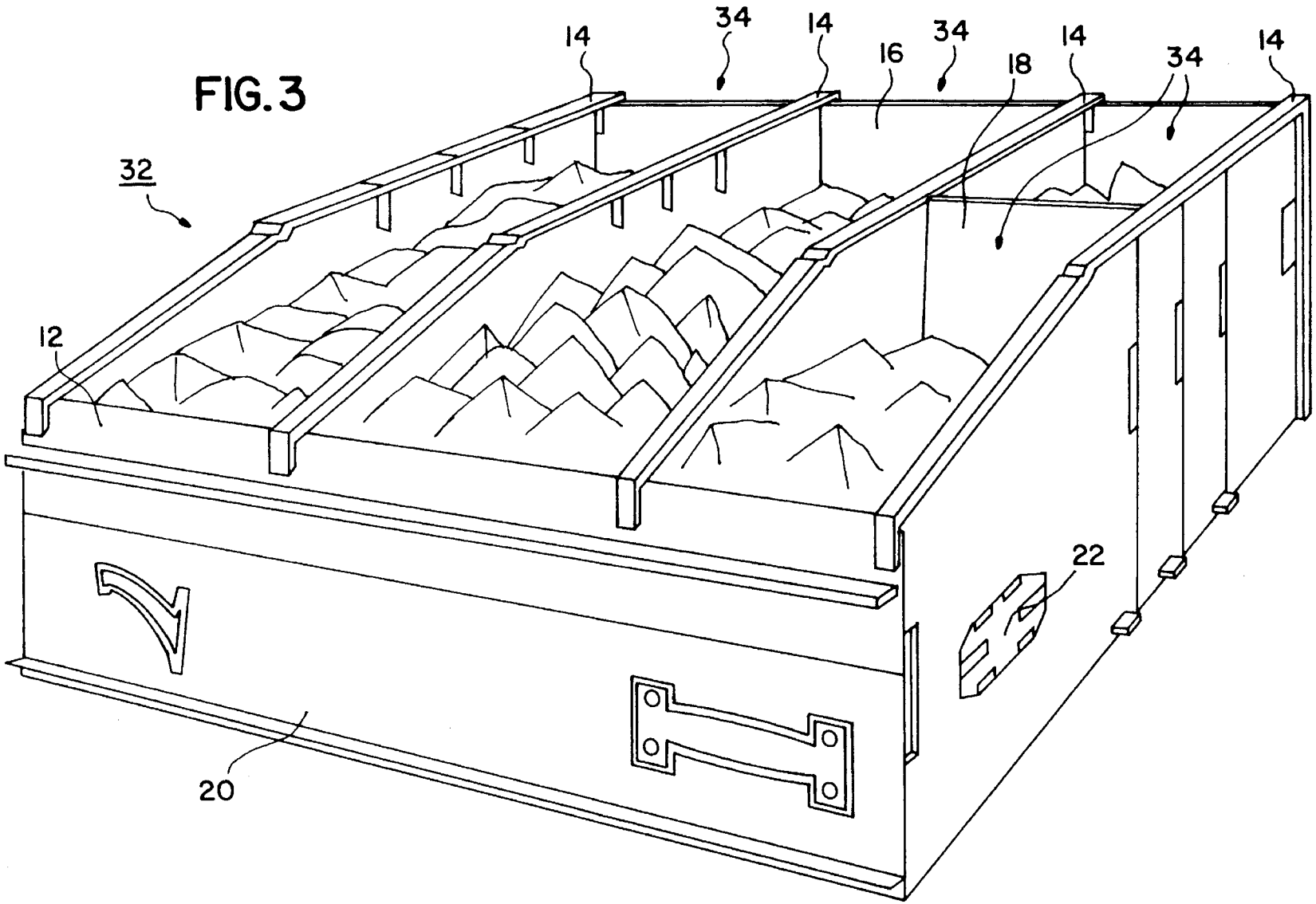
FIG. 3 is a particular unit configuration of a modular display compartment according to the present invention.

Referring to FIG. 3, there is shown a particular unit configuration 32 of a modular display compartment that is fully assembled with additional side panels 14. This particular unit configuration 32 has a total of four areas 34, or subcompartments 34, formed therein for product storage. These subcompartments 34 are formed by a front panel 12, the side panels 14, a back panel 16, and a lateral divider 18. This particular unit configuration 32 also has a product identifier strip 20 for identifying the products stored within each subcompartment 34.

Figure 4:
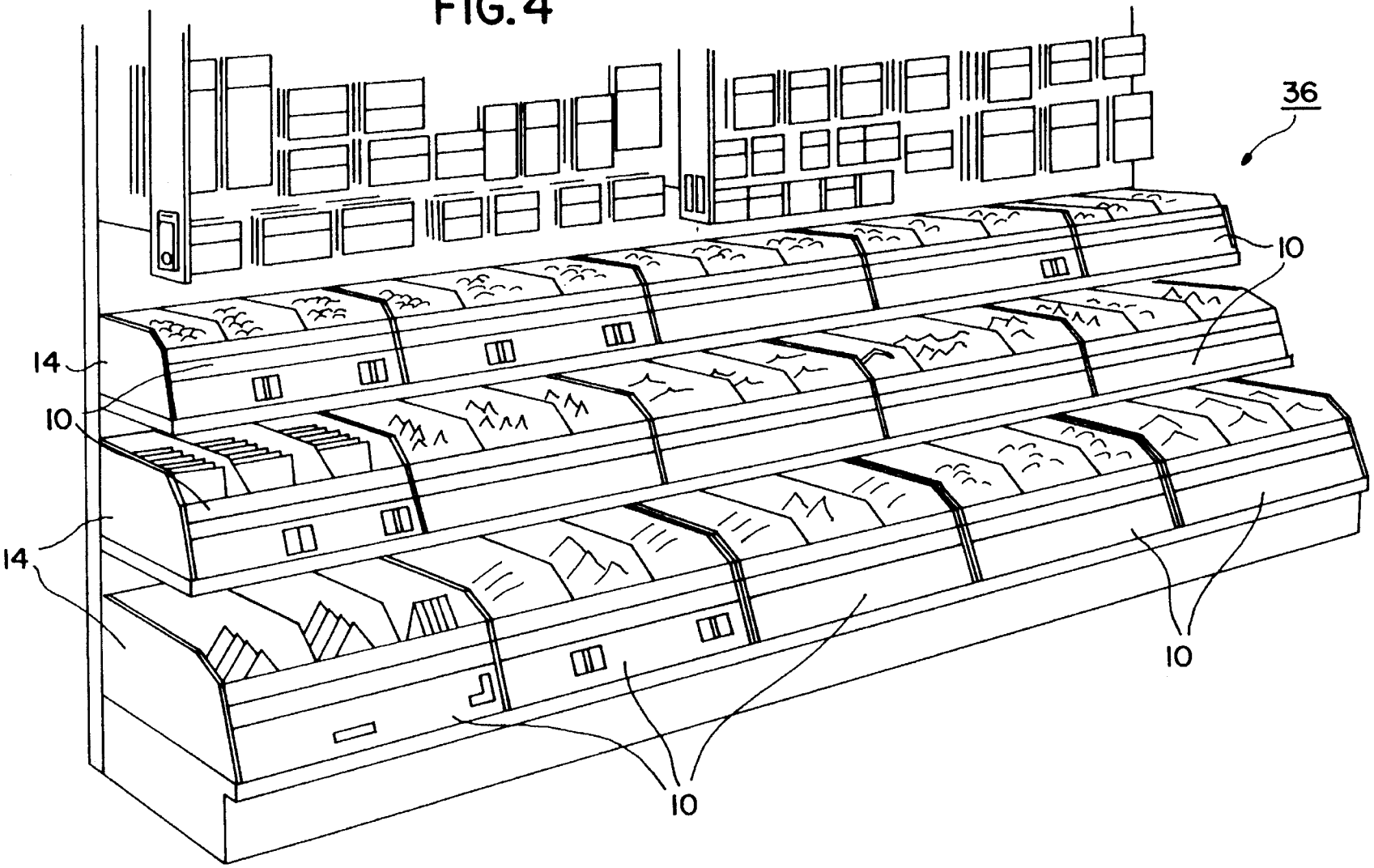
FIG. 4 is a typical product display comprising several modular display compartments according to the present invention.

Referring to FIG. 4, there is shown a typical product display 36 comprising several modular display compartments 10 arranged side-by-side on several shelving levels. The length of the modular display compartments 10 on each shelf is the same. However, the length of the modular display compartments 10 on the bottom shelf is greater than length of the modular display compartments 10 on the middle shelf, and the length of the modular display compartments 10 on the middle shelf is greater than length of the modular display compartments 10 on the top shelf. These differences in modular display compartment length are obtained by snap off sections in the side panels 14, which will be described in great detail below.

Figure 5:
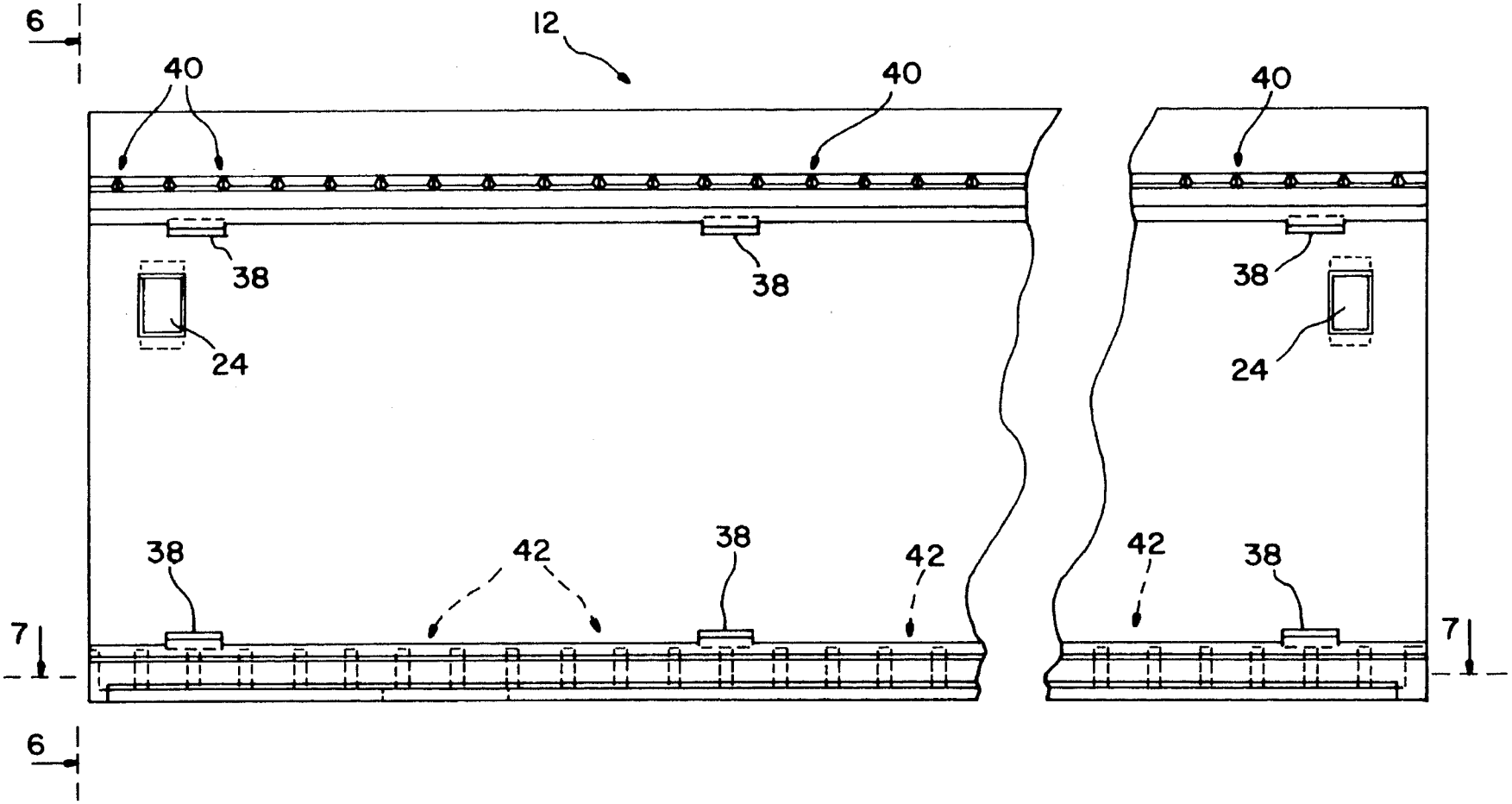
FIG. 5 is a broken front view of a front panel of a modular display compartment according to the present invention.
Figure 7:
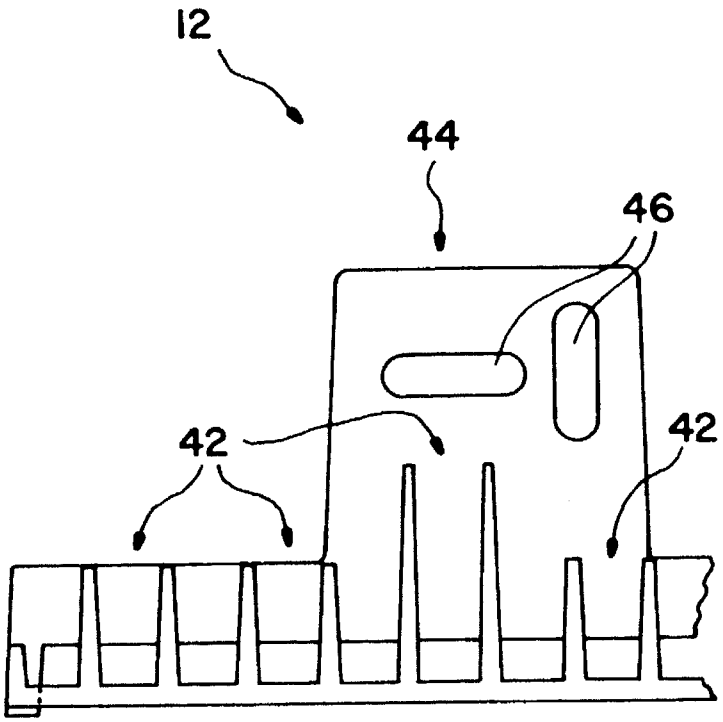
FIG. 7 is a partial cross-sectional view of the front panel shown in FIG. 5 taken along line 7—7 of FIG. 7.
Figure 6:
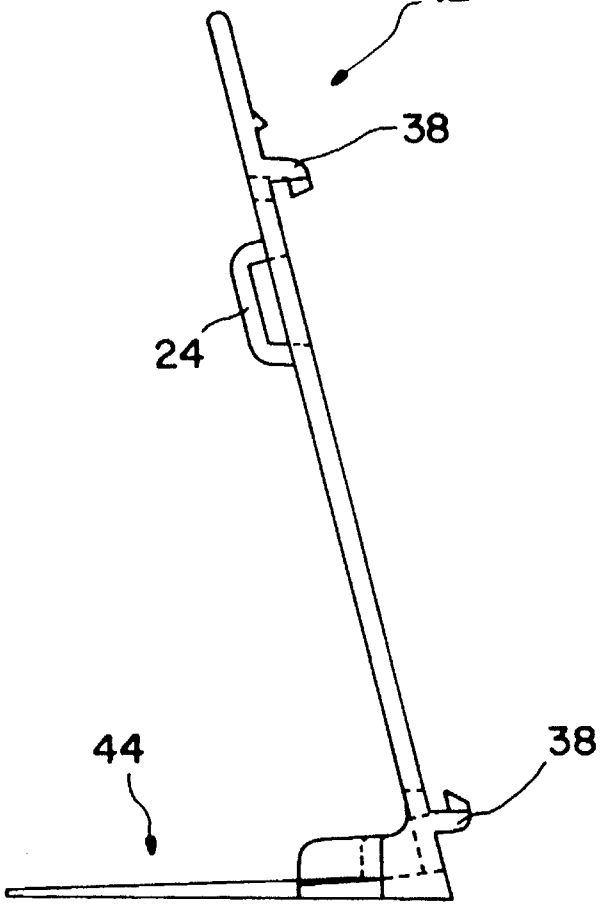
FIG. 6 is an end view of the front panel shown in FIG. 5 taken along line 6—6 of FIG. 5.
Figure 8:
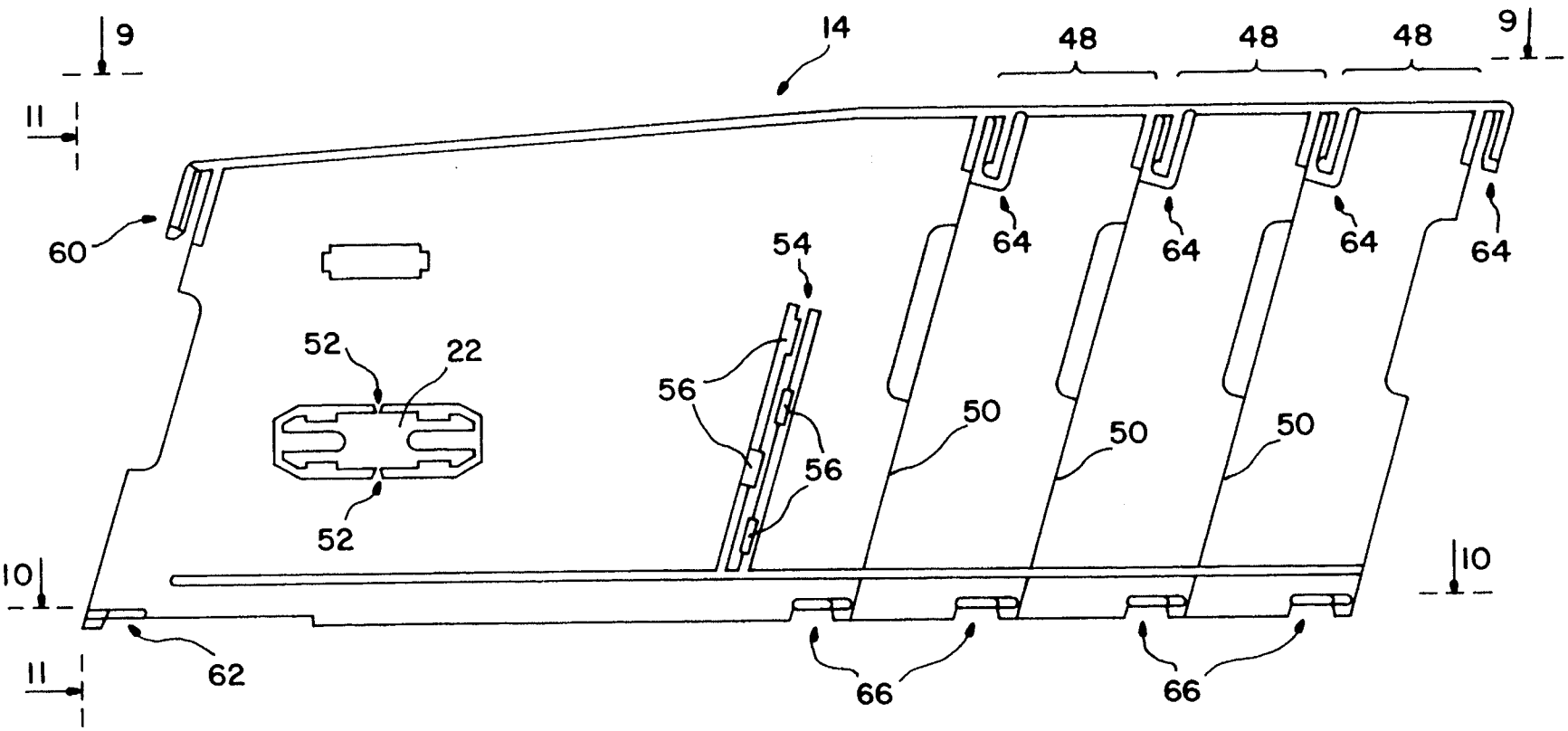
FIG. 8 is a side view of a side panel of a modular display compartment according to the present invention.
Figure 9:
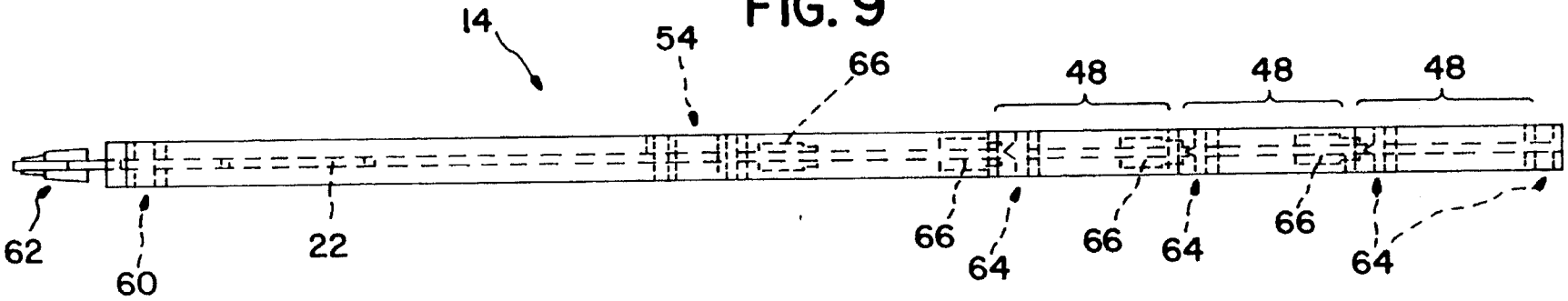
FIG. 9 is a top view of the side panel shown in FIG. 8 taken along line 9—9 of FIG. 8.
Figure 10:
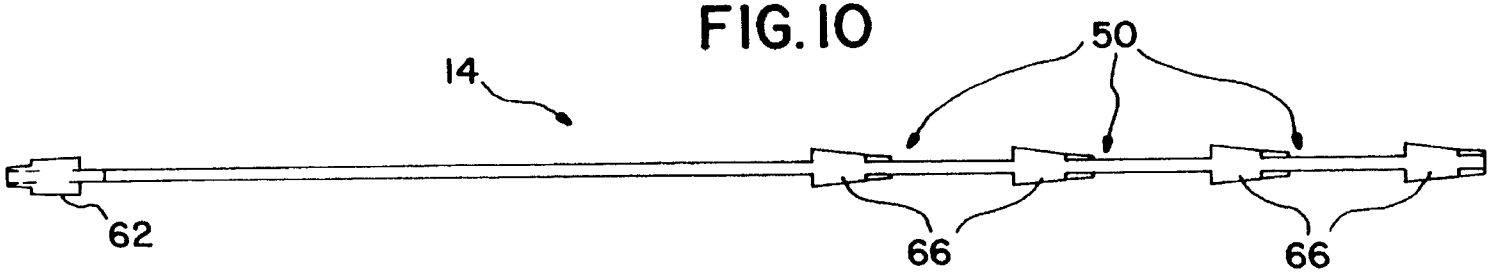
FIG. 10 is a cross-sectional view of the side panel shown in FIG. 8 taken along line 10—10 of FIG. 8.

Referring to FIGS. 5—7, there is shown a front panel 12 of a modular display compartment according to the present invention. These figures show in detail that the front panel 12 has angled guides 38 formed therein for retaining a product identifier strip 20. It should be noted that the angled guides 38 are part of the snap fit connection scheme wherein a perforated peg panel 26 may be attached to the front panel 12.

The front panel 12 also has the connector members 24 formed therein which mate with the snap out connector pins 22, as previously described. Furthermore, the front panel 12 has upper slotted seats 40 and lower slotted seats 42 formed therein for vertically aligning interlocking side panels 14. The upper slotted seats 40 and the lower slotted seats 42are formed to mate with an upper front extrusion 60 and a lower front extrusion 62, respectively, formed in each side panel 14 (see FIGS. 8–11). Finally, the front panel 12 has several base extensions 44 formed therein for balancing and stabilizing the front panel 12 in a substantially upright position. The base extensions 44 have apertures 46 formed therein so as to allow mating screws 48 to pass therethrough for securing the front panel 12 to flooring or shelving. It should be noted that the front panel 12 is preferably positioned at an angle so as to facilitate viewing a product identifier strip 20 or other items which may be displayed on a perforated peg panel 26.

Referring to FIGS. 8–11, there is shown a side panel 14 of a modular display compartment according to the present invention. These figures show in detail that each side panel 14 has snap off sections 48 for adjusting the depth of a modular compartment 10 so as to adapt to different shelving dimensions. The snap off sections 48 are realized by the formation of weak seams 50 which extend substantially vertical from the bottom to the top of each side panel 14. Thus, the snap off sections 48 can be literally snapped off each side panel 14 at the weak seams 50 so as to shorten the length of a modular compartment 10.

As previously discussed, each side panel 14 also has a snap out connector pin 22 formed therein which is used to secure together adjacent modular compartments 10. During the injection molding formation of the side panel 14, two small bridges 52 are created to link the snap out connector pin 22 to the main body of the side panel 14. Thus, the snap out connector pin 22 can be separated from the main body of the side panel 14 by literally snapping, or breaking, the bridges 52.

Each side panel 14 also has slotted extrusions 54 formed therein on each side thereof each of which mates with and secures therein one end of a lateral divider 18. The slotted extrusions 54 have raised tabs 56 formed thereon which mate with openings 58 formed in each lateral divider 18 (see FIGS. 18 and 19) and act to lock a lateral divider 18 into a secure position within the slotted extrusions 54. Each side panel 14 further has an upper front extrusion 60 and a lower front extrusion 62 formed therein which mate with the upper slotted seats 40 and the lower slotted seats 42, respectively, formed in the front panel 12. Similarly, each side panel 14 has upper rear extrusions 64 and lower rear extrusions 66 formed therein which mate with upper slotted seats 68 and lower slotted seats 70, respectively, formed in the back panel 16 (see FIGS. 12–14).

Figure 13:
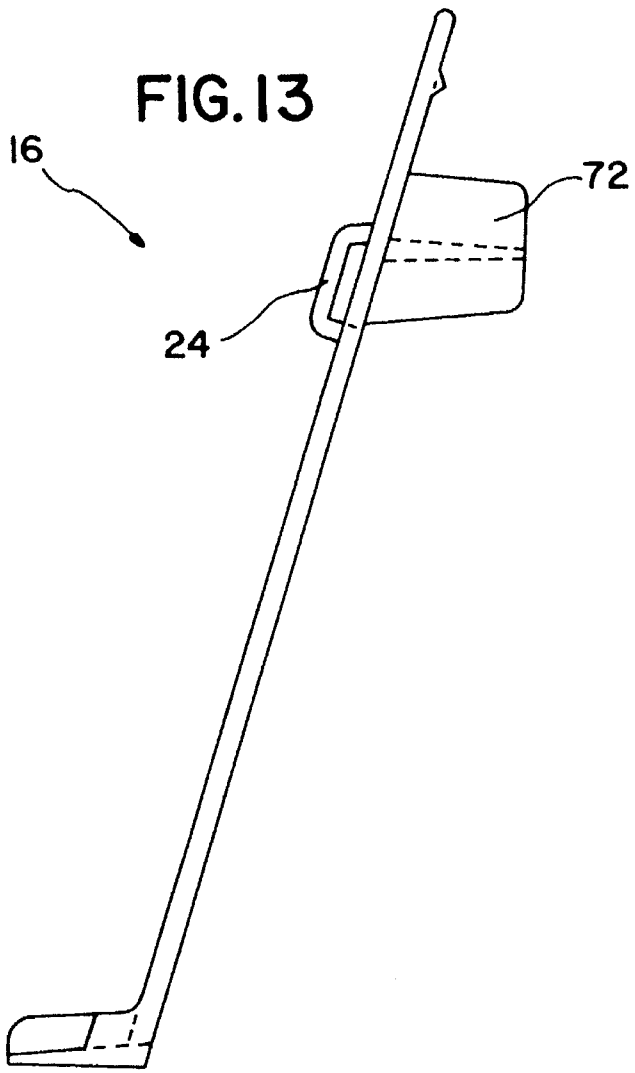
FIG. 13 is an end view of the back panel shown in FIG. 12 taken along line 13—13 of FIG. 12.
Figure 11:
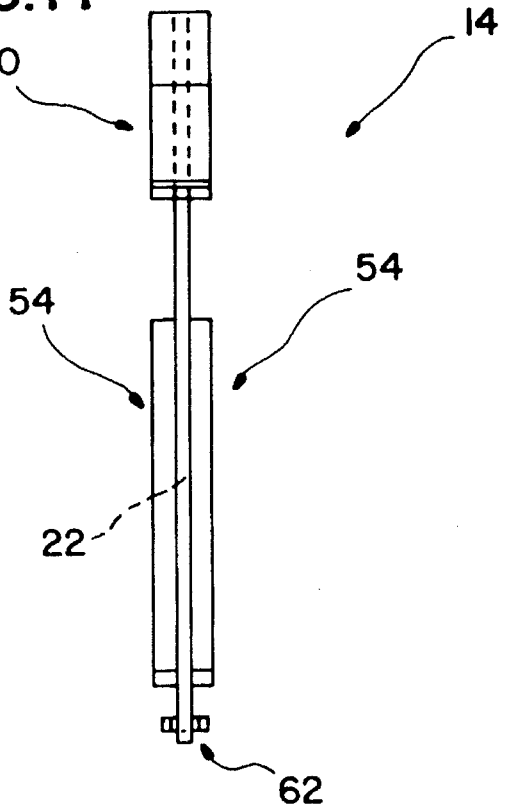
FIG. 11 is an end view of the side panel shown in FIG. 8 taken along line 11—11 of FIG. 8.
Figure 12:
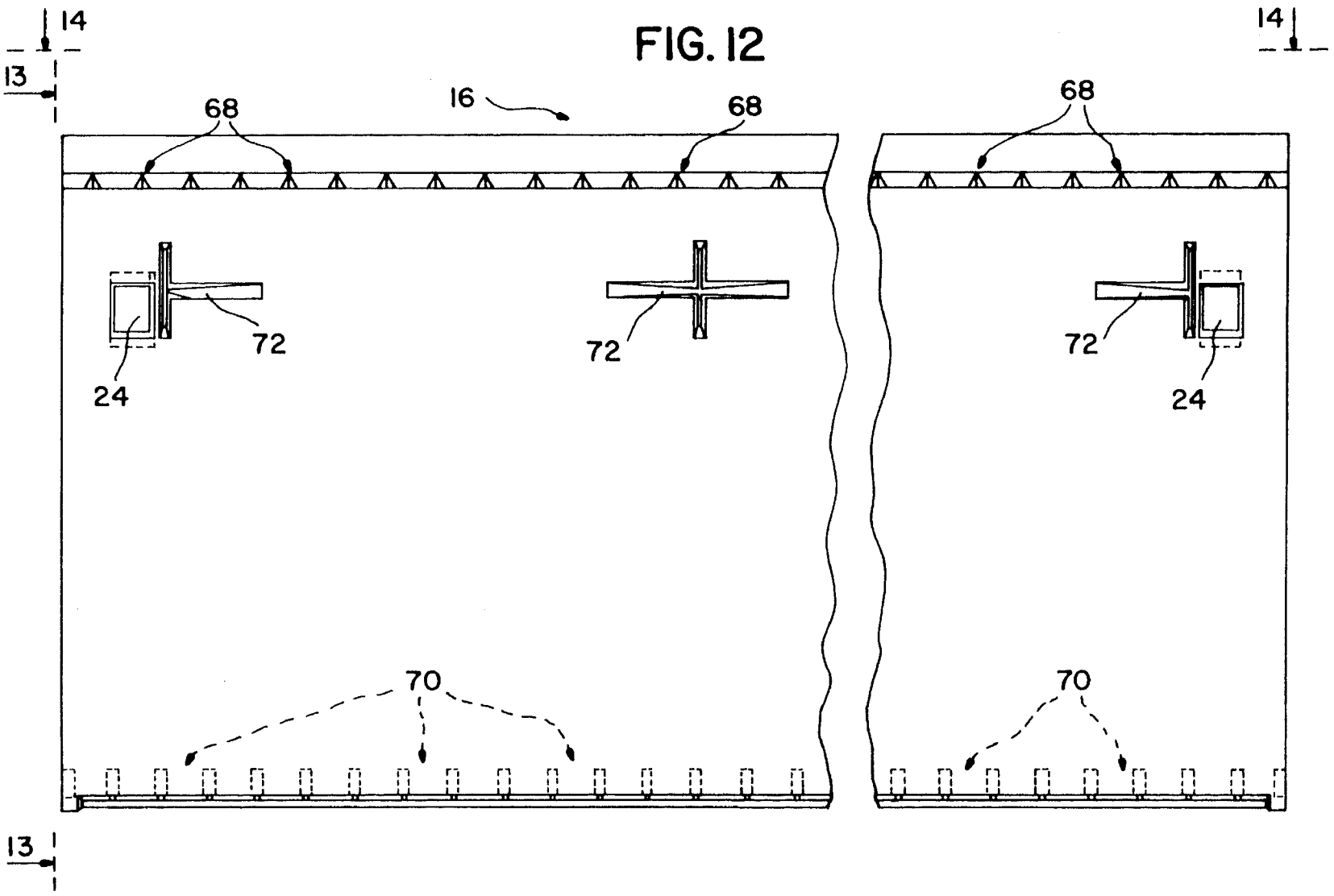
FIG. 12 is a rear view of a back panel of a modular display compartment according to the present invention.
Figure 14:
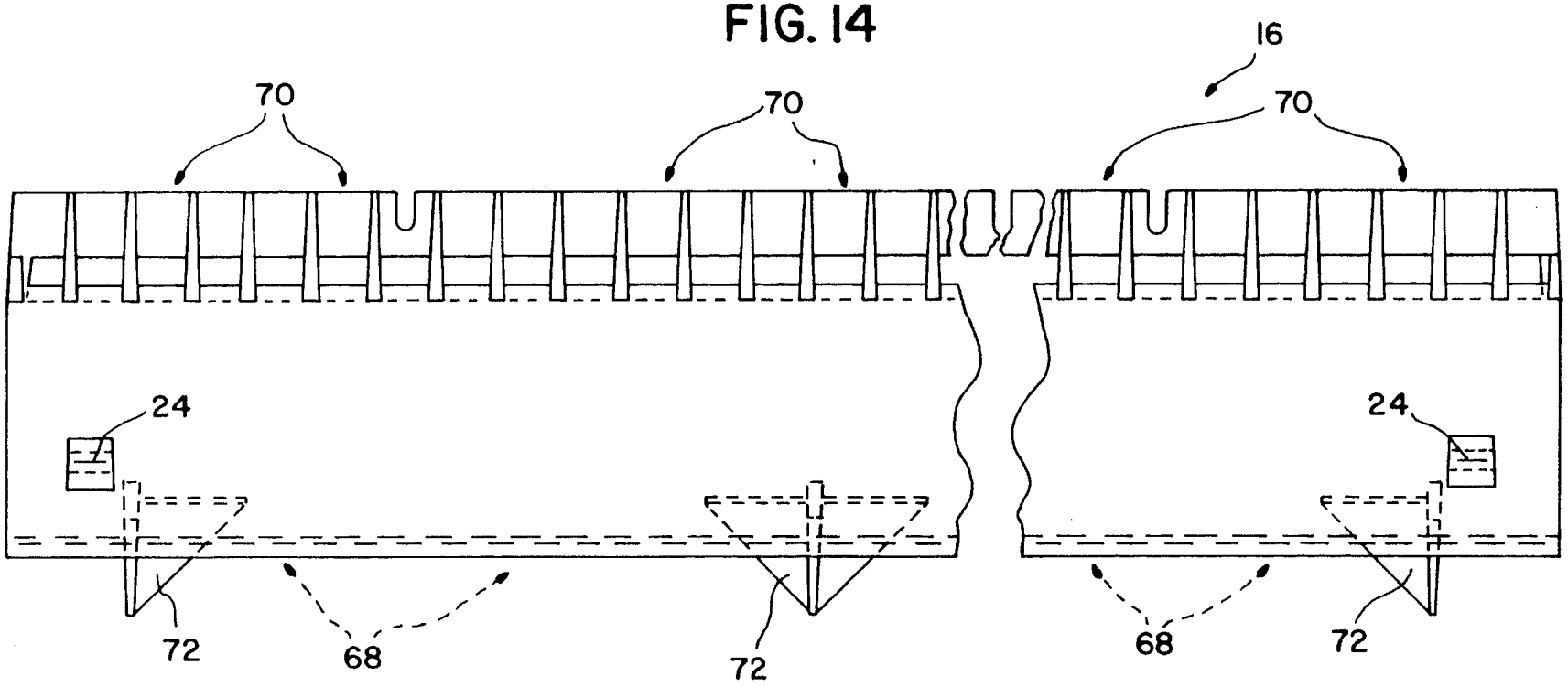
FIG. 14 is a top view of the back panel shown in FIG. 12 taken along line 14—14 of FIG. 12.

Referring to FIGS. 12–14, there is shown a back panel 16 of a modular display compartment according to the present invention. The back panel 16 has the connector members 24 formed therein which mate with the snap out connector pins 22, as previously described. The back panel 16 also has upper slotted seats 68 and lower slotted seats 70 formed therein for vertically aligning interlocking side panels 14. The upper slotted seats 68 and the lower slotted seats 70 are formed to mate with the upper rear extrusions 64 and the lower rear extrusions 66, respectively, formed in each side panel 14. Furthermore, the back panel 12 has several wall extensions 72 formed therein for bracing the back panel 16, and hence an entire modular compartment 10, against a vertical wall or vertical shelving backing.

Figure 15:
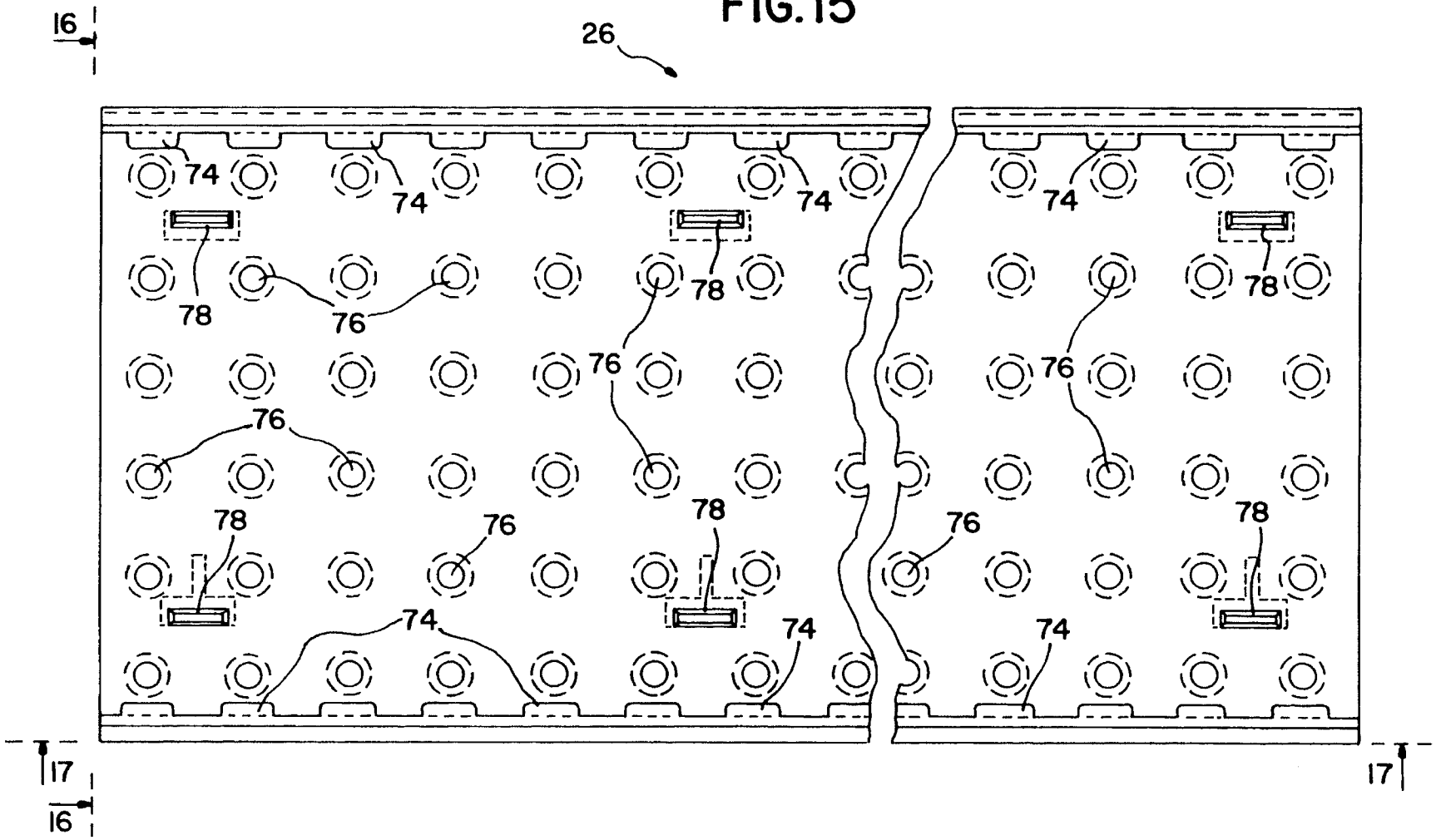
FIG. 15 is a front view of a perforated peg panel of a modular display compartment according to the present invention.
Figure 17:
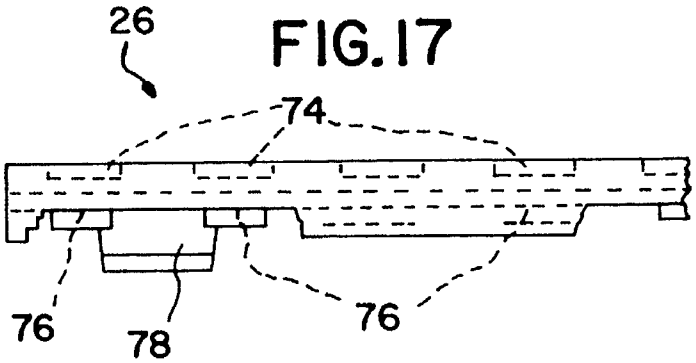
FIG. 17 is a partial cross-sectional view of the perforated peg panel shown in FIG. 15 taken along line 17—17 of FIG. 15.
Figure 16:
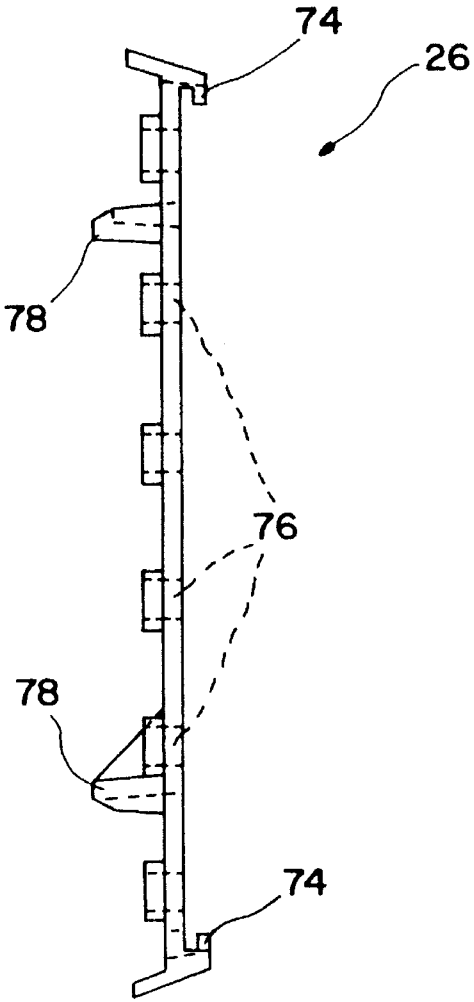
FIG. 16 is an end view of the perforated peg panel shown in FIG. 15 taken along line 16—16 of FIG. 15.

Referring to FIGS. 15–17, there is shown a perforated peg panel 26 of a modular display compartment according to the present invention. These figures show in detail that the perforated peg panel 26 has guides 74 formed therein for retaining a product identifier strip 20. These figures also show in detail that the perforated peg panel 26 has a plurality of equidistantly spaced perforations 76 formed therein for supporting mating peg clips 80 and 98 (see FIGS. 20–27) which in turn may support actual representative products.

The perforated peg panel 26 also has connector members 78 formed therein which mate with the angled guides 38 on the front panel 12 so as to effect the snap fit connection scheme between the perforated peg panel 26 and the front panel 12. The snap fit connection scheme is realized by engaging the outwardly facing connector members 78 with the inwardly facing angled guides 38.

Figure 19:
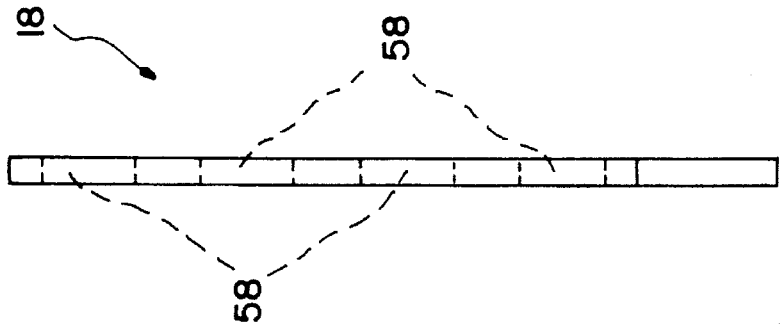
FIG. 19 is a side view of the lateral divider shown in FIG. 18 taken along line 19—19 of FIG. 18.
Figure 18:
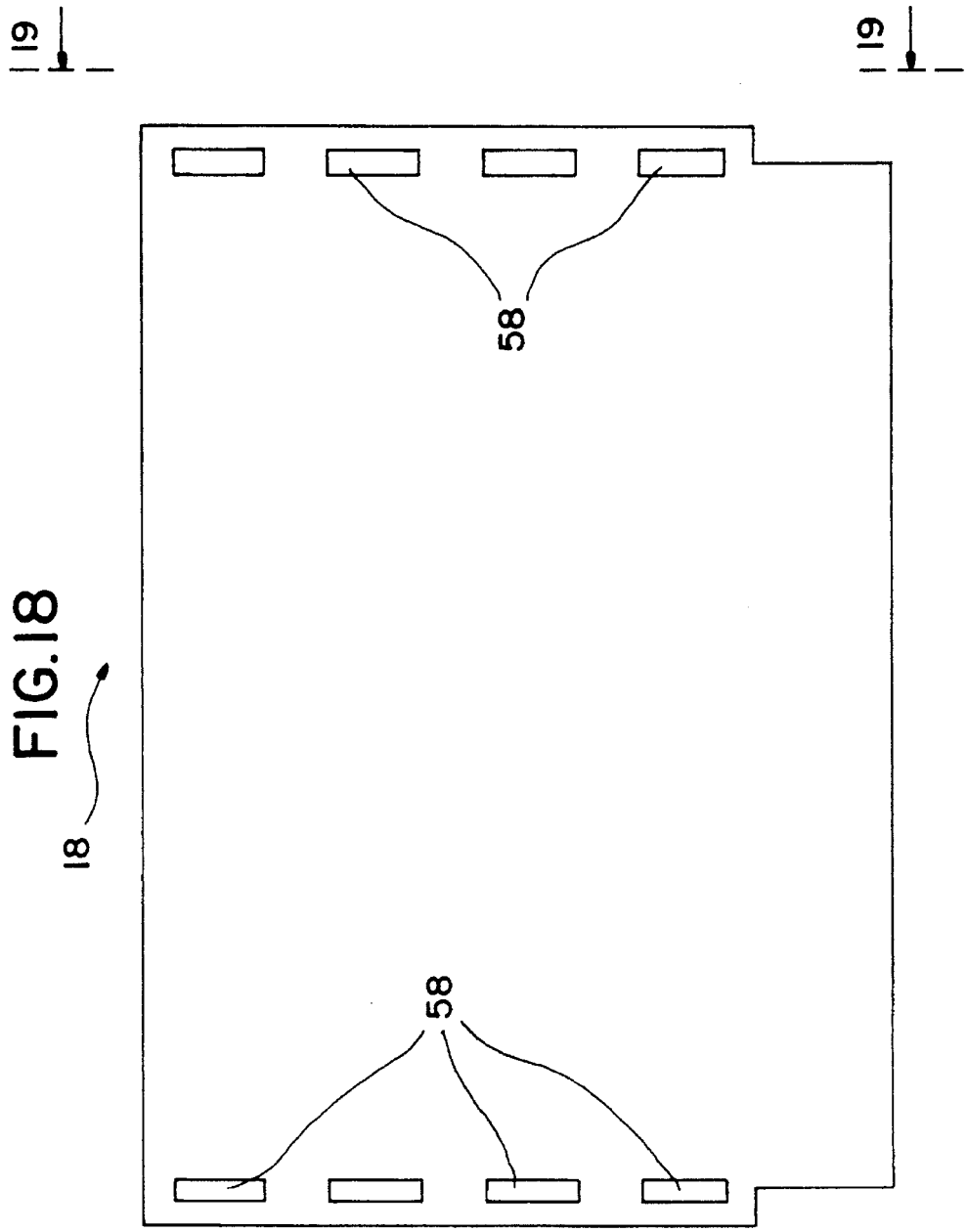
FIG. 18 is a front view of a lateral divider of a modular display compartment according to the present invention.
Figure 20:
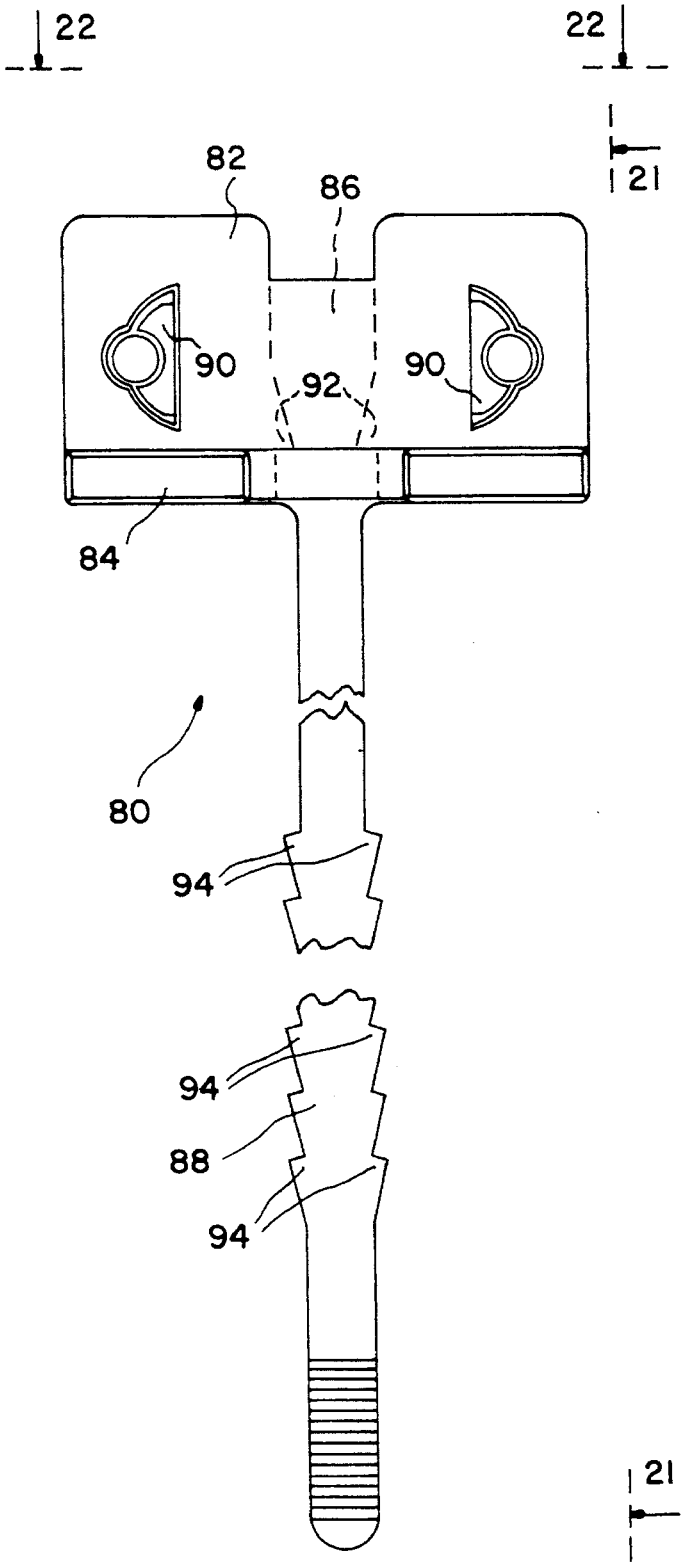
FIG. 20 is a front view of a cable tie peg clip for a modular display compartment according to the present invention.
Figure 21:
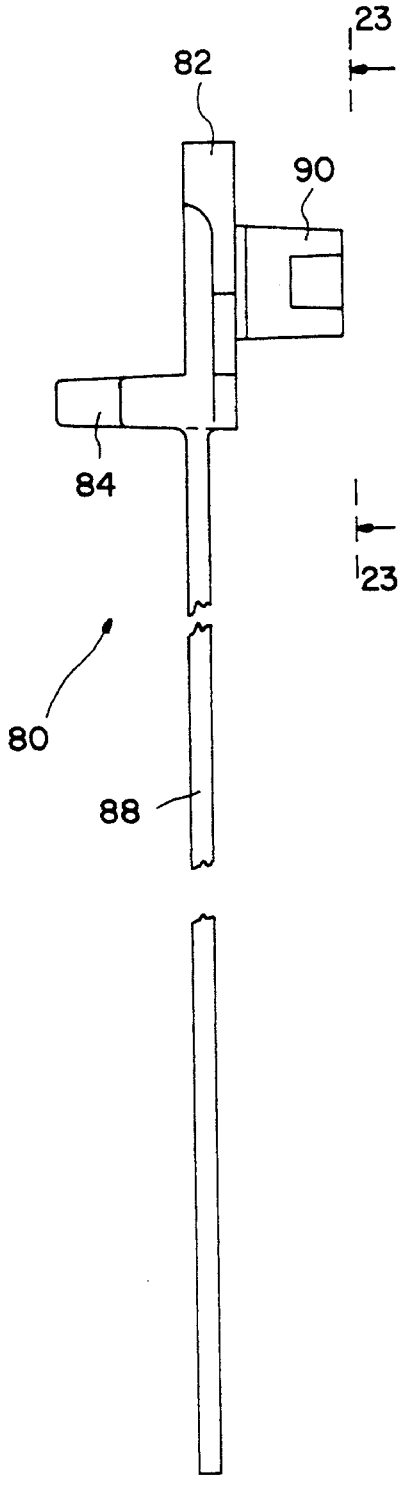
FIG. 21 is a side view of the cable tie peg clip shown in FIG. 20 taken along line 21—21 of FIG. 20.
Figure 23:
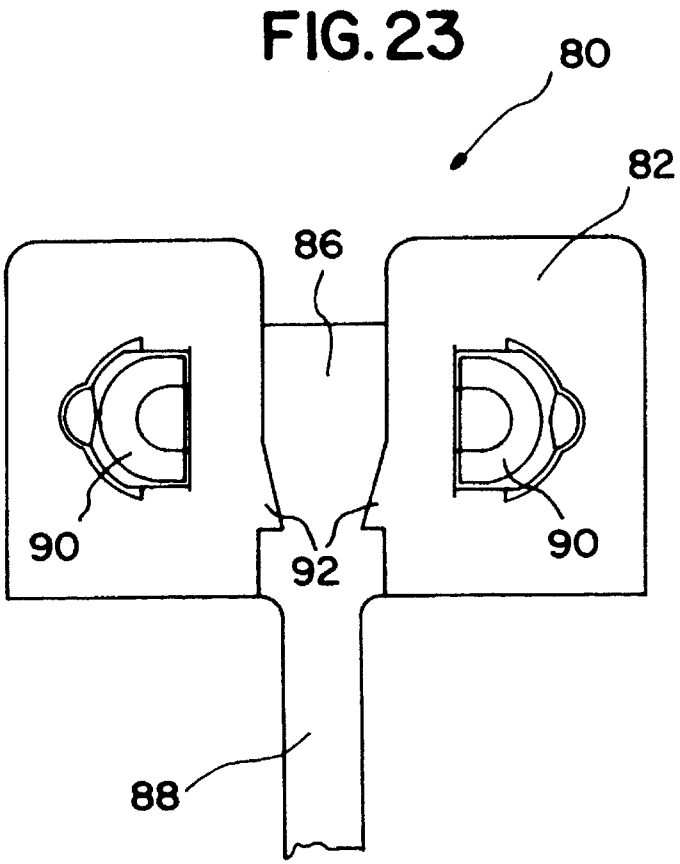
FIG. 23 is a partial rear view of the cable tie peg clip shown in FIG. 20 taken along line 23—23 of FIG. 21.
Figure 22:
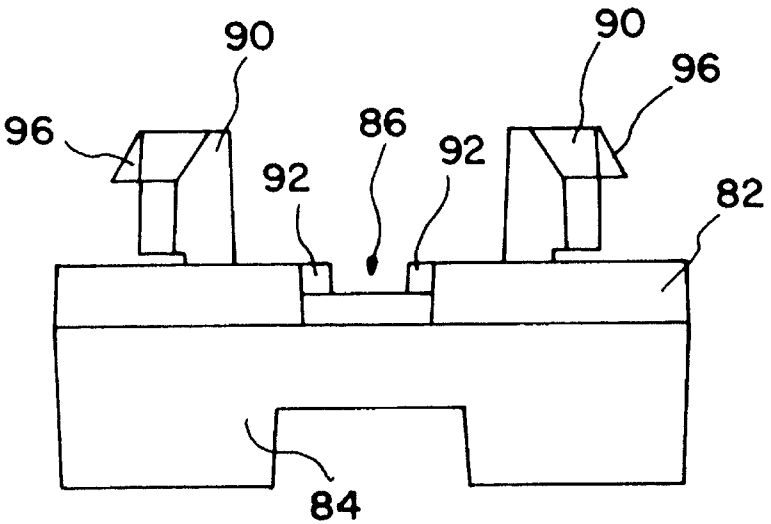
FIG. 22 is an end view of the cable tie peg clip shown in FIG. 20 taken along line 22—22 of FIG. 20.
Figure 24:
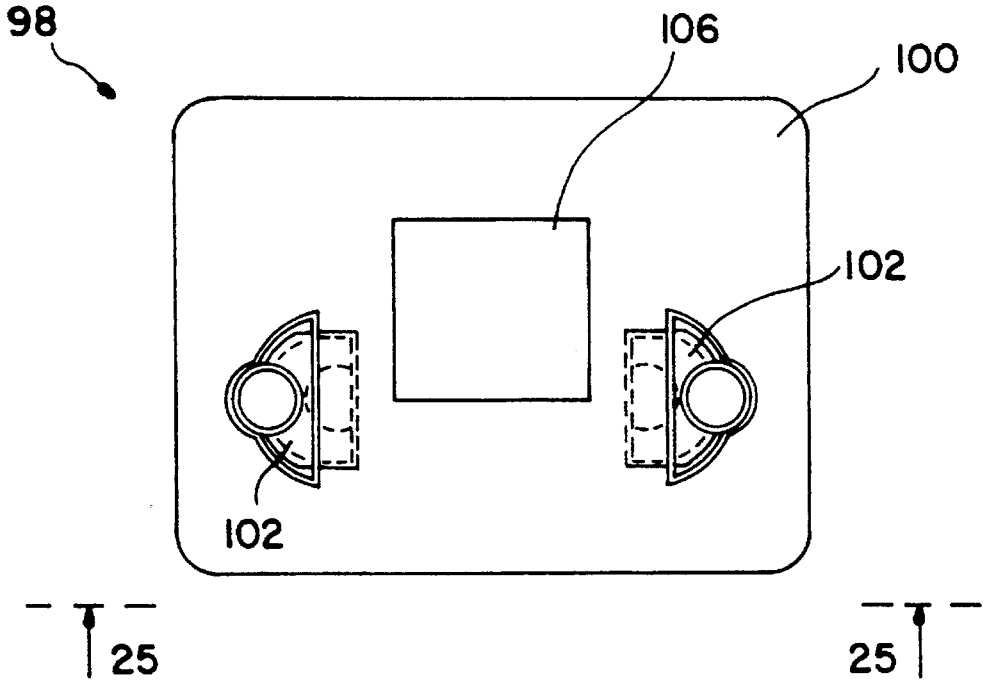
FIG. 24 a front view of a flat peg clip for a modular display compartment according to the present invention.
Figure 25:
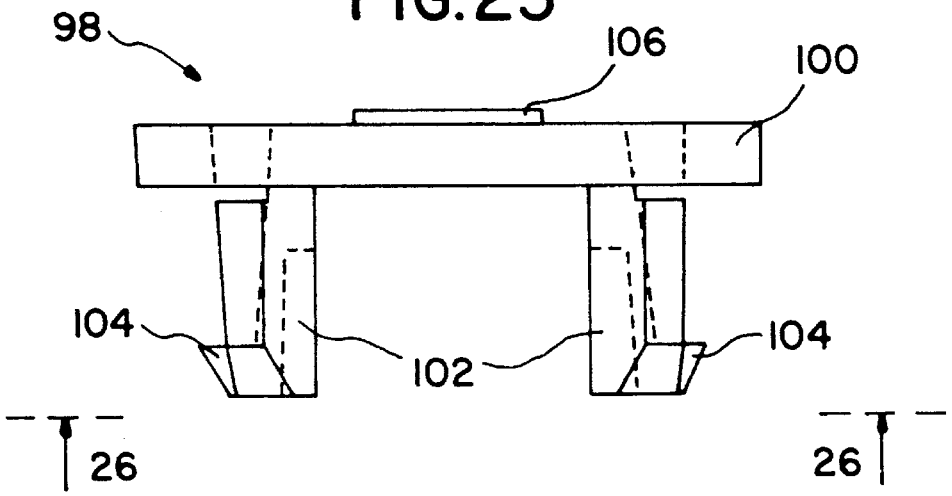
FIG. 25 is a bottom view of the flat peg clip shown in FIG. 24 taken along line 25—25 of FIG. 24.
Figure 27:
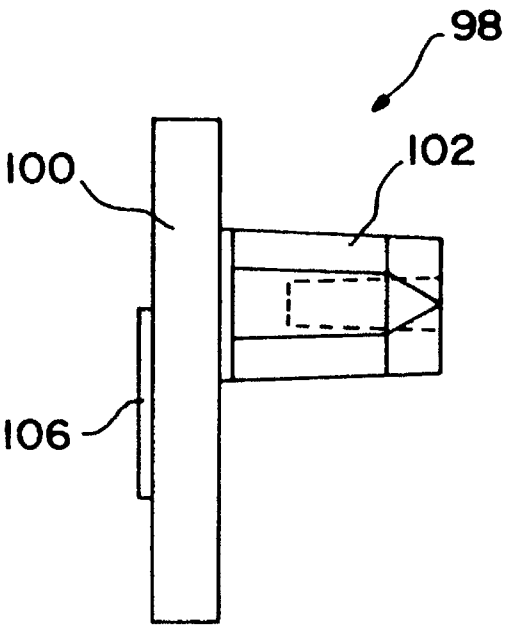
FIG. 27 is a side view of the flat peg clip shown in FIG. 24 taken along line 27—27 of FIG. 26.
Figure 26:
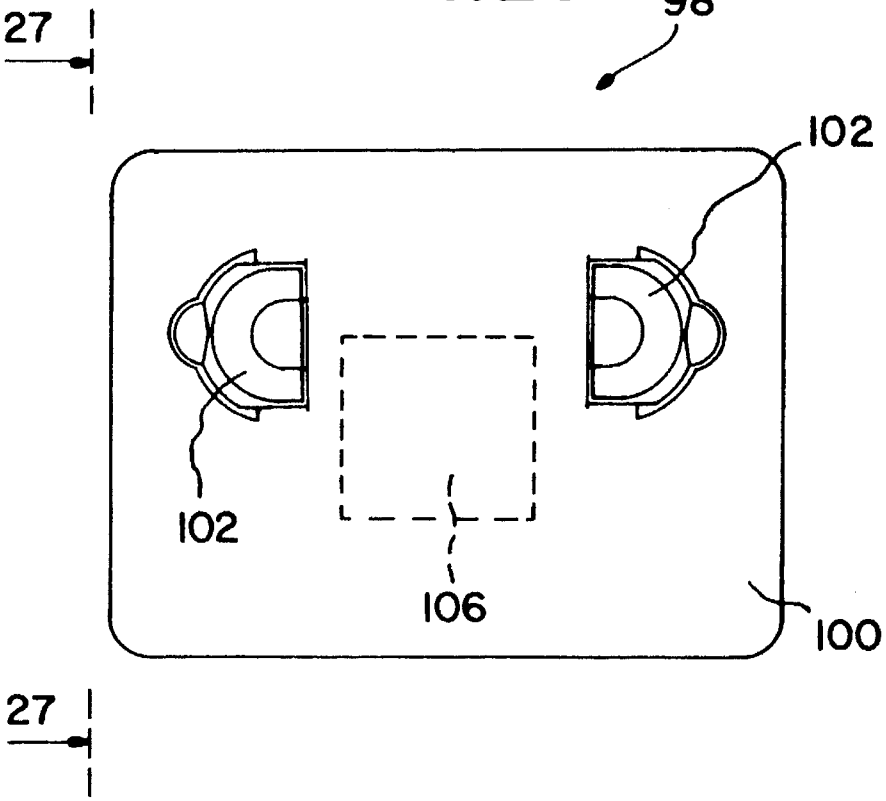
FIG. 26 is a rear view of the flat peg clip shown in FIG. 24 taken along line 26—26 of FIG. 25.

Referring to FIGS. 18 and 19, there is shown a lateral divider 18 of a modular display compartment according to the present invention. Each lateral divider 18 has openings 58 formed therein which mate with the raised tabs 56 formed on the slotted extrusions 54 of each side panel 14. The mating arrangement between the openings 58 and the raised tabs 56 insures that the lateral divider 18 is locked into a secure position within the slotted extrusions 54, and between adjacent side panels 14.

Referring to FIGS. 20–23, there is shown a cable tie peg clip 80 for a modular display compartment according to the present invention. The cable tie peg clip 80 comprises a main body portion 82 having a holding platform 84 and a locking channel 86 formed therein. Extending from the main body portion 82 are a cable tie 88 and a pair of peg members 90. The locking channel 86 has a pair of locking members 92 formed therein and the cable tie 88 has a plurality of corresponding pairs of locking members 94 formed thereon.

The cable tie peg clip 80 mates with a perforated peg panel 26 by engaging the pair of peg members 90 within a corresponding pair of the perforations 76 formed in the perforated peg panel 26. Each peg member 90 has a locking tab 96 for securing the cable tie peg clip 80 in its mating position on the perforated peg panel 26.

Prior to securing the cable tie peg clip 80 on the perforated peg panel 26, the cable tie 88 may be wrapped around an actual representative product and inserted within the locking channel 86 so as to effectuate a locking engagement between the locking channel locking members 92 and the cable tie locking members 94. Thus, when the cable tie peg clip 80 is later secured on the perforated peg panel 26, the cable tie is secured in its position within the locking channel 86 between the main body portion 82 of the cable tie peg clip 80 and the front of the perforated peg panel 26.

It should be noted that the holding platform 84 is used to support actual representative products held against the main body portion 82 of the cable tie peg clip 80 with the cable tie 88. It should also be noted that, since the cable tie 88 and the peg members 90 must be flexible to perform their desired functions, the cable tie peg clip 80 is typically fabricated of a flexible injection molded plastic material such as unfilled polypropylene.

Referring to FIGS. 24–27, there is shown a flat peg clip 98 for a modular display compartment according to the present invention. The flat peg clip 98 is very similar to the cable tie peg clip 80 described above, although lacking the holding platform 84, the locking channel 86, and the cable tie 88. Thus, the flat peg clip 98 comprises only a main body portion 100 and a pair of peg members 102. Of course, just as with the cable tie peg clip 80, each peg member 102 has a locking tab 104 for securing the flat peg clip 98 to a perforated peg panel 26.

Similar to the cable tie peg clip 80, the flat peg clip 98 is also used to support actual representative products on a perforated peg panel 26. To perform such a function, a piece a double backed tape 106, or other similar adhesive, is secured to the main body portion 100 of the flat peg clip 98. Thus, actual representative products may be secured to the double backed tape 106, or other similar adhesive, so as to be displayed on the front of the modular display compartment 10.

It should be noted that, since the peg members 102 must be flexible to perform their desired functions, the flat peg clip 98 is typically fabricated of a flexible injection molded plastic material such as unfilled polypropylene.

With the present invention modular display compartment 10 now fully described, it can thus be seen that the primary objective set forth above is efficiently attained and, since certain changes may be made in the above-described modular display compartment 10 without departing from the scope of the invention, it is intended that all matter contained in the above description or shown in the accompanying drawings shall be interpreted as illustrative and not in a limiting sense.

What is claimed is:

1. A modular compartment for displaying products therein, said modular display compartment comprising:

a front panel having a display surface, said display surface having a plurality of angled guides formed thereon, said front panel having a plurality of vertically aligned upper slotted seats and lower slotted seats formed therein;

a plurality of side panels each having an upper front extrusion and a lower front extrusion formed therein for mating interlock with said upper slotted seats and said lower slotted seats, respectively, of said front panel, each said side panel also having at least one weak seam formed widthwise therein for facilitating the separation of at least one snap off section therefrom and thereby allowing for lengthwise adjustment of each side panel, each said side panel further having an upper rear extrusion and a lower rear extrusion formed therein at a rear end thereof and along a rear edge of each weak seam; and a back panel having a plurality of vertically aligned upper slotted seats and lower slotted seats formed therein for mating interlock with said upper rear extrusions and said lower rear extrusions, respectively, of said side panels.

2. The modular display compartment as defined in claim 1, further comprising a perforated peg panel having a display surface, said display surface having a plurality of guides formed thereon and a plurality of perforations formed therein, said perforated peg panel having a plurality of connector members formed therein for mating engagement with said plurality of angled guides of said front panel.

3. The modular display compartment as defined in claim 2, wherein said plurality of perforations in said perforated peg panel are equidistantly spaced in a matrix pattern.

4. The modular display compartment as defined in claim 3, further comprising at least one peg clip having a main body portion and at least one peg member, wherein each said peg member is sized so as to fit within a corresponding perforation in said perforated peg panel.

5. The modular display compartment as defined in claim 4, wherein each said peg clip is a cable tie peg clip comprising said main body portion having a locking channel formed therein and a cable tie and said at least one peg member extending therefrom, wherein said locking channel has at least one locking member formed therein and said cable tie has at least one corresponding locking member formed thereon.

6. The modular display compartment as defined in claim 5, wherein said at least one peg member comprises a pair of peg members, and wherein said pair of peg members are spaced so as to allow engagement with a corresponding pair of perforations in said perforated peg panel.

7. The modular display compartment as defined in claim 6, wherein said main body portion has a holding platform formed therein.

8. The modular display compartment as defined in claim 6, wherein each said peg member has a locking tab for securing said cable tie peg clip on said perforated peg panel.

9. The modular display compartment as defined in claim 4, wherein each said peg clip is a flat peg clip comprising said main body portion and a pair of peg members, wherein said pair of peg members are spaced so as to allow engagement with a corresponding pair of perforations in said perforated peg panel.

10. The modular display compartment as defined in claim 9, wherein each said peg member has a locking tab for securing said flat peg clip on said perforated peg panel.

11. The modular display compartment as defined in claim 2, wherein said front panel has at least one base extension formed therein for balancing and stabilizing said front panel in a substantially upright position.

12. The modular display compartment as defined in claim 11, wherein each said base extension has at least one aperture formed therein so as to allow mating screws to pass therethrough for securing said front panel to flooring or shelving.

13. The modular display compartment as defined in claim 2, wherein said front panel display surface is an outer display surface, wherein said front panel has an inner compartment surface substantially opposite said outer display surface, wherein said plurality of upper slotted seats are formed on said outer display surface, and wherein said plurality of lower slotted seats are formed on said inner compartment surface.

14. The modular display compartment as defined in claim 2, further comprising a product identifier strip which slidably engages with said plurality of angled guides of said front panel and with said plurality of guides of said perforated peg panel.

15. The modular display compartment as defined in claim 2, wherein each said side panel has at least one snap out connector pin formed therein, each said snap out connector pin having connector means formed on opposing ends thereof.

16. The modular display compartment as defined in claim 15, wherein said front panel has at least one connector member formed therein on opposing ends thereof, each said connector member being sized so as to mate with said connector means on each said snap out connector pin.

17. The modular display compartment as defined in claim 15, wherein said back panel has at least one connector member formed therein on opposing ends thereof, each said connector member being sized so as to mate with said connector means on each said snap out connector pin.

18. The modular display compartment as defined in claim 2, wherein each said side panel has at least one pair of slotted extrusions formed therein on each side thereof.

19. The modular display compartment as defined in claim 18, further comprising at least one lateral divider, wherein the ends of each said lateral divider are sized so as to fit between said slotted extrusions in each said side panel.

20. The modular display compartment as defined in claim 19, wherein said slotted extrusions in each said side panel have raised tabs formed thereon, and wherein the ends of each said lateral divider have openings formed therein which mate with said raised tabs so as to lock each lateral divider between said slotted extrusions in each said side panel.

21. The modular display compartment as defined in claim 2, wherein said back panel has an inner compartment surface and an outer wall surface substantially opposite said inner compartment surface, wherein said outer wall surface at least one wall extension formed therein.

22. The modular display compartment as defined in claim 21, wherein said plurality of upper slotted seats are formed on said outer wall surface, and wherein said plurality of lower slotted seats are formed on said inner compartment surface.

* * * * *